US006379261B1

(12) United States Patent
Hart

(10) Patent No.: US 6,379,261 B1
(45) Date of Patent: Apr. 30, 2002

(54) SWING TRAINER HAVING DOUBLE BENT SHAFT

(76) Inventor: Bruce A. Hart, 254 Nesbutt Dr., Mina, SD (US) 57462

( * ) Notice: Subject to any disclaimer, the term of this patent is extended or adjusted under 35 U.S.C. 154(b) by 0 days.

(21) Appl. No.: 09/479,616

(22) Filed: Jan. 7, 2000

Related U.S. Application Data

(63) Continuation-in-part of application No. 09/128,827, filed on Aug. 4, 1998, now abandoned.

(51) Int. Cl.[7] ..... A63B 55/00

(52) U.S. Cl. ..... 473/292; 473/288; 473/314; 473/291; 473/292; 473/334

(58) Field of Search ..... 473/316, 288, 473/281, 290, 314, 340, 291, 292, 334

(56) References Cited

U.S. PATENT DOCUMENTS

| | | | | | |
|---|---|---|---|---|---|
| 2,146,048 | A | * | 2/1939 | Barnhart | 473/316 |
| 3,231,281 | A | | 1/1966 | Wallo | |
| 3,246,894 | A | | 4/1966 | Salisbury | |
| 3,351,346 | A | | 11/1967 | Strahan | |
| 3,428,325 | A | | 2/1969 | Atkinson | |
| 4,227,694 | A | * | 10/1980 | Drake | 473/316 |
| 4,511,147 | A | | 4/1985 | Olsen | |
| 4,602,788 | A | | 7/1986 | Wendt | |
| 4,795,153 | A | * | 1/1989 | Thomas | 473/316 |
| 5,083,790 | A | | 1/1992 | Wheatley | |
| 5,121,925 | A | * | 6/1992 | Blundo | 473/334 |
| 5,215,307 | A | | 6/1993 | Huffman | |
| 5,427,376 | A | | 6/1995 | Cummings | |
| 5,609,531 | A | | 3/1997 | Gates | |
| 5,657,985 | A | * | 8/1997 | Dahlstrom et al. | 473/523 |
| 5,792,002 | A | * | 8/1998 | Bothwell | 473/316 |
| 5,816,935 | A | * | 10/1998 | Se-Hyup | 473/313 |
| 6,152,832 | A | * | 11/2000 | Chandler, III | 473/293 |

* cited by examiner

*Primary Examiner*—Mark S. Graham
*Assistant Examiner*—Raeann Gordon
(74) *Attorney, Agent, or Firm*—Moore & Hansen

(57) ABSTRACT

A golf swing training and muscle exercising apparatus or swing trainer is provided which is designed to be used indoors as well as outdoors. The golf swing trainer includes a double bent shaft having upper and lower end portions separated by a center portion, the center portion being interconnected, at opposite ends thereof, with each of the upper and lower end portions by first and second joining portions. The upper and lower end portions are substantially straight and have respective center lines, wherein the center line for the upper end portion is the first center line, the center line for the center portion is the second center line and the center line for the lower end portion is the third center line, the first center line lying at an angle A to the second center line an the second center line lying at an angle B to the third center line. The first center line, second center line and third center line preferably lie in the same plane and angle B is preferably greater than angle A. The preferred golf swing trainers will include a training grip and a weighted head which is detachably engaged with the distal or lower end of the shaft. The weighted head will preferably weigh from about 0.25 to about 3.0 pounds.

5 Claims, 2 Drawing Sheets

SWING TRAINER HAVING DOUBLE BENT SHAFT

CROSS-REFERENCE TO RELATED APPLICATIONS

The present application is a Continuation-In-Part Application of U.S. patent application Ser. No. 09/128,827 filed Aug. 4, 1998 now abandoned, entitled GOLF SWING BUILDER AND SLICE BUSTER CLUB.

FIELD OF INVENTION

The field of the present invention relates to devices for golf swing training and muscle exercising devices which enable users to develop the proper elements of a golf swing while exercising the muscles generally utilized in a proper golf swing.

BACKGROUND OF THE INVENTION

At whatever level of play a golfer has reached, there is continuing need for practice in order to improve or perfect one's golf swing. It is every educated golfer's desire to consistently execute a perfect well-timed swing where everything comes together in an easy relaxed motion. In such a swing the club head will meet the ball at an optimal attitude and will continue along the target line, propelling the ball flight where the golfer has aimed it. Whether a beginner, a low handicapper or week-end golfer, it is every golfer's desire to consistently execute a perfect well-timed swing where everything comes together in an easy relaxed motion. In such a swing the club head will meet the ball at an optimal attitude and will continue along the target line, propelling the ball flight where the golfer has aimed it. To occasionally execute such a swing provides a peak experience to any golfer's game. To repeatedly execute such a swing is the ultimate goal to which every golfer aspires as he or she contemplates the state of their game.

A golf swing is a combination of a number of actions or elements completed in series. An improper execution of any one or more of these actions will produce other than an optimum swing. While such elements can be evaluated individually, it is their flowing sequential execution that provides a dynamic interrelationship to produce a desired golf swing. Individually, the actions or elements that make up the preferred golf swing can be generally summarized as; the hand placement on the club and the club extension, release, and follow-through as the club is swung. These elements occur sequentially, with the upper body rotating as the club is swung and a weight transfer occurring from one leg to the other. During extension, the golfer's weight is generally on his or her back leg. At release, it is evenly distributed, and at follow-through, his or her weight will have transferred to the leading leg.

The present invention provides a dynamic training system whose repeated use will condition a golfer to perform a proper golf swing. Whereas, earlier devices and arrangements have addressed improving or modifying aspects of the swing only. For example, certain earlier devices have dealt with club grips for positioning a golfer's hands around the club grip and, to that end, have provided grooves, finger pads, and ridges to fit the contours of his hands. Some such grips are shown in patents by Papin, U.S. Pat. No. 1,638,454; English, U.S. Pat. No. 3,111,322; Beebe, U.S. Pat. No. 2,628,100; Smith, U.S. Pat. No. 2,046,191; Ottman, U.S. Pat. No. 2,298,505 and Cummings et al., U.S. Pat. No. 5,427,376.

In addition to earlier U.S. Patents disclosing club grips, an earlier patent to Barnhart, U.S. Pat. No. 2,146,048, recognized a benefit to weight displacement in using a bent golf club shaft. This weighted shaft arrangement was, however, intended only to dampen a shock imparted into the golf club shaft when the head struck a golf ball.

A number of other golf club training and guiding devices have been proposed for training golfers with respect to maintaining the proper golf club movement while addressing and striking the golf ball. See for example U.S. Pat. Nos. 5,121,925; 5,083,790; 3,583,707; 3,351,346; 3,341,208; 3,339,927; 2,756,056; 2,520,287; 1,944,942 and 1,567,530. Most of these patents utilize rings, and/or arc devices for aiding the golfer during the golf swing and some of these devices utilize guides wherein the club may be connected to a ring or arc to indicate to the golfer the proper club swing movement. While these patents may provide help to some, they may be viewed by others a cumbersome, and to hard to understand, which lead to limited use and ultimately to non-usage.

Other swing training clubs and related devices have also been proposed. See, for example, U.S. Pat. Nos. 5,050,874; 4,653,757; 4,580,786; 4,262,573; 4,229,002; 3,738,661; 3,703,294; 3,614,108; 3,462,156; 3,429,571; 3,319,963; 2,848,234; 2,328,408; and 1,893,920. Most of these devices are believed to be to large, to heavy, to expensive and/or demonstrate a lack of portability or durability. As such, these devices are believed to be impractical for convenient use and/or commercial distribution.

Additionally, a bent shaft and weighted head arrangement is shown for a golf swing training device in a patent by Strahan, U.S. Pat. No. 3,351,346. This swing trainer, however, while it recognizes a benefit to a bent shaft and a weighted end displaced from a golf swing center line, is significantly different in structure from the trainer of the present invention in that it teaches a trainer shaft having a single bend only and it arranges a weight to encircle the shaft and to be adjustable vertically thereon. Also, the Strahan trainer is used to retrain a golfer to perform an inside-out golf swing correcting only a single aspect of the swing.

U.S. Pat. No. 4,511,147 to Olsen also teaches a weighted training club having a double bent shaft and a training grip on the proximate end of the shaft. The training club is generally the same length as a fall length club, however, and would be difficult to use indoors where space is limited. Furthermore, the weighted end of the club has a set weight which may or may not be an appropriate weight for golfers of various size/age or strength. Therefore, it is believed that such a training club would be of only limited use to golfers of a certain size and strength and/or to seasonal golfers living in colder climates where one might find themselves indoors in close quarters during the winter or during otherwise inclement weather; quarters too close to use a swing trainer the length of a regular golf club.

Accordingly, it will be appreciated that there is a continuing need for new and improved training clubs that will benefit golfers of all ages and genders; a swing trainer which can be easily used inside and out, by users of various size and strength. The present invention provides advantages over the prior devices and the prior methods used to resurface these and other surfaces, and also offers other advantages over the prior art and solves other problems associated therewith.

SUMMARY OF THE INVENTION

A golf swing training and muscle exercising apparatus or swing trainer is provided which is designed to be used indoors as well as outdoors. The golf swing trainer includes a double bent shaft having upper and lower end portions separated by a center portion, the center portion being interconnected at opposite ends with each of the upper and lower end portions by first and second joining portions. The upper and lower end portions being substantially straight and having respective center lines, wherein the center line for the upper end portion is the first center line, the center line for the center portion is the second center line and the center line for the lower end portion is the third center line, the first center line lying at an angle A to the second center line an the second center line lying at an angle B to the third center line. The first center line, second center line and third center line preferably lie in the same plane and angle B is preferably greater than angle A. This permits the weighted head at the distal end of the swing trainer to be centered somewhat more closely to an extensions of the first center line allowing the weighted head, while still offset from the first center line, to feel more centered to the user when gripping the proximal end of swing trainer. It will be appreciated that this is advantageous in a shortened club, because of the potential overemphasis of the offset when, it is believed to be too great and which may result from the use of the shortened club length. In preferred embodiments, angle A preferably is from about 12 degrees to about 18 degrees, angle B is preferably from about 18 degrees to about 25 degrees and angle B is greater than angle A. The preferred golf swing trainers of the present invention will include a training grip on the proximate end and the shaft will be made of metal bar stock. The preferred golf swing trainers will also include a weighted head detachably engaged with the distal end, and weighted head will preferably weigh from about 0.5 to about 3.0 pounds. In preferred embodiments, the swing trainer of the present invention, may be sold with a series of exchangeable weighted heads having varying weights; preferably the weights of the different weighted heads will include 0.5 pounds; 1.0 pound; 1.5 pounds; 2.0 pounds; 2.5 pounds; perhaps 3.0 pounds; and/or any possible combination thereof. The preferred golf swing trainers will also be, preferably, about 26 inches or less in length, more preferably about 24 inches or less in length, more preferably about 22 inches or less and most preferably from about 20 to about 22 inches in length, for easy use inside or out.

The golf swing training device or swing trainer of the present invention has a weighted head and a double bent shaft that is bent oppositely at spaced apart points along the shaft to off-set a lower end portion of the shaft outwardly from an upper end portion of the shaft. The weighted head is secured on the lower end portion of the shaft and a hand grip is telescoped over the upper end portion of the shaft. The preferred hand grip is a training grip which includes contoured depressions to accommodate a golfer's fingers when properly griping the shaft. The training grip has elevated portions between the gripping area for the golfer's thumb and forefinger, so as to position the golfer's hands appropriately relative to the shaft of the swing trainer. The weighted head is removable and replaceable with weighted heads of any number of practical weights.

The shaft is double bent, such that the weight provided by the head will be generally centered outwardly and above the center line of the upper end portion of the shaft. Because the respective center lines of the upper and lower end portions of the shaft, and the center portion of the shaft reside in the same plane, the weighted head at the lower end of the shaft will bias the shaft toward a tilt in one direction or the other away from a perfectly upright position if the plane in which these respective portions of the shaft reside is not held in a vertical position with respect to the vector of the gravitational pull acting on the weighted head when the golfer using the swing trainer is at the top of the back swing. In this way, the user will be able to feel the difference between a proper back swing where the swing trainer is held in a position in which the respective portions of the shaft fall within such a vertical plane, and an improper back swing where the respective portions of the shaft are held in such a position that they fall in a plane other than a vertical plane. This helps the golfer to feel the difference between a proper swing and an improper swing. Therefore, repeated use of the swing trainer will allow the golfer direct his or her practice toward repeated use of the proper swing technique, such that this swing technique can be learned and even memorized.

It is an object of the present invention to provide a golf club swing training club that will permit the golfer to be comfortable and to use their most natural swing movement so long as they keep the shaft and the weighted head in a vertical plane at the top of the back swing. It is a further object to provide a swing trainer which is short in length so that it can be easily stored and carried, and easily used indoors where space for swing clubs and/or swing trainers is limited. Another advantage is to provide a training club that can be easily used by all golfers regardless of age, gender, and left or right handed users. The variable weight of the detachable weighted heads make the present swing trainer especially versatile in this respect. A further object is making it of durable, and yet, inexpensive components which may be assembled and modified as desired, without extraordinary skills or any tools needed.

It is another general object of the present invention to provide a golf swing trainer for use by a golfer to train himself or herself to consistently perform a well-timed, well-executed golf swing, the club head finishing high and along a desired target line.

Another object is to provide a golf swing trainer, where, with practice, a golfer will imprint on his or her mind a proper and preferred golf swing that he can then consistently execute with a conventional golf club.

Still another object of the present invention in a golf swing trainer is to provide a device that has essentially a standard golf club configuration for swinging as a golfer would normally swing a conventional golf club.

Still another object of the present invention in a golf swing trainer is to provide a trainer that can be used without prior preparation or set-up when time allows, to provide, with repeated use, muscle conditioning, a mental imprinting, and motion blending and reinforcement of a desired golf swing.

Still another object of the present invention in a golf swing trainer is to provide a trainer similar to a golf club that includes a grip that is contoured for exact positioning of the golfer's hands and can be used repeatedly without wear.

In accordance with the above objects, the present invention in a golf swing trainer provides a device that has similarities to a conventional golf club, that has a shaft that is bent at spaced points to off-set a lower end thereof from the upper end portion, to which lower end portion, a weighted head is connected. The upper end portion preferably includes a grip contoured to accommodate and properly position a golfer's hands closed around the grip. The shaft bends, respectively, are at similar but not the same angles, one above and the other below the plane of the shaft at spaced apart points. The shaft sections or segments above and below the bends are generally not parallel to one another and the head end thereof, will be offset with respect to the upper end portion or upper section to which the grip is secured. The bends are spaced apart a distance to provide the desired off-set of the lower end portion to which a weighted club head is secured, from what would preferably be the line of the shaft of a conventional golf club, also known as the golf club effective center line.

The off-setting of the head a distance from the effective center line provides a castering effect after the weighted club head has swung through the bottom of the swing arc, just below where it would contact a golf ball. Also, both the shaft off-set and the weighted head are offset, so that when the swing trainer is swung, the offset will accentuate the left and right side extension of the golfer's body and rolling action of the golfer's hands, one over the other, at release.

The club head is preferably significantly heavier than is a normal golf club head, and that head is construed such that its mass is centered at a point outwardly from and above the head center with respect to where the shaft end connects to the head. To provide the desired weight distribution, the trainer head is preferably made from a metal bar stock that is bent through several angles back on itself such that the greater percentage or portion of that head is centered at a point outward from and above the head center. Also, the area within the bent bar stock is left open to minimize air resistance when swung, and the bar stock is preferably coated with a paint, plastic or like material.

The head weight and its off-set arrangement when the trainer is swung provides an emphasis to all the elements of a golf swing. The weight positioning creates a moment whereby, that club head will tend to finish higher, travel faster, and emphasizes the roll-over of the hands over one another at release. Thereby, a dynamic interrelationship between the golf swing elements is provided. A golfer, properly positioning his or her hands around the grip, can swing the trainer through extension, release and follow-through, with the trainer head weight and its arrangement causing him or her to be more aware of each aspect of his swing as well as muscle conditions, enabling him or her to later consistently perform the same swing smoothly and uniformly with a conventional golf club.

In practice, when the trainer is drawn back prior to swinging, the weighted head encourages a full extension. During the swing, when the head travels through a lowest point just below where a ball would be positioned, the off-set head weighting arrangement pulls the golfer's hands through a proper release. The weighted head then tends to hold its path of travel along the target line through follow-through. The weighted head and its location away from a normal club effective center line, during a swing, also acts to pull a golfer's weight from one side to the other, the upper body rotating therewith.

Still further objects and advantages of the present invention will become apparent from a consideration of the ensuing description and accompanying drawings.

These and various other advantages and features of novelty that characterize the present invention are pointed out with particularity in the claims annexed hereto informing a part hereof. However, for a better understanding of the present invention, its advantages and other objects obtained by its use, reference should be made to the drawings, which form a further part hereof and to the accompanying descriptive matter, in which there is illustrated and described preferred embodiments of the present invention.

BRIEF DESCRIPTION OF THE DRAWINGS

The invention will be further described in connection with the accompanying drawings, in which:

FIG. 4 is a schematic front view of a person 2, grasping the swing training device or "swing trainer" 10 of the present invention, in a stance similar to that taken when the person 2 is addressing a golf ball and showing in broken line (1) in the initial stage of a back swing; (2) at the top of the backswing; and (3) at the release stage of a follow through.

DETAILED DESCRIPTION OF THE PREFERRED EMBODIMENTS

Figure 2:
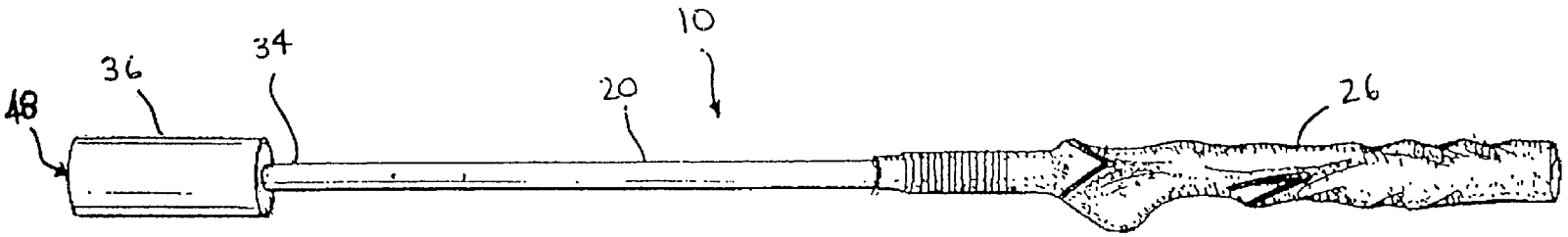
FIG. 2 is a side view of the preferred swing training device 10 of FIG. 1 showing the swing trainer from the perspective of a user addressing the device or "club" 10 and also from the perspective of the bottom of a vertical plane as described herein when the swing trainer 10 is held in a proper position at the top of a backswing when the center lines 42, 44, 46 of the upper and lower end portions 24, 34 and the center portion 10, respectively, all lie in the same plane.
Figure 3:
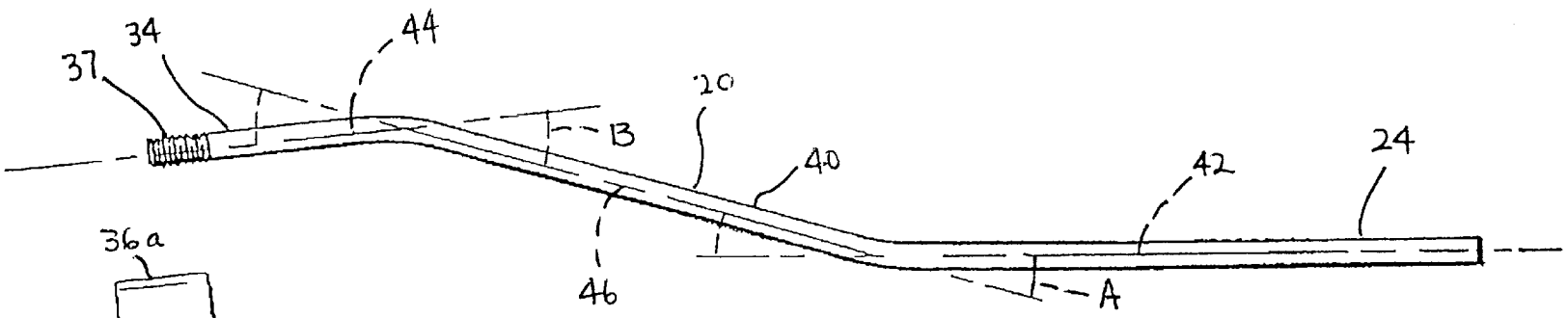
FIG. 3 is a plan view similar to that shown in FIG. 1, but showing only the shaft 20 of the present swing training device 10.
Figure 1:
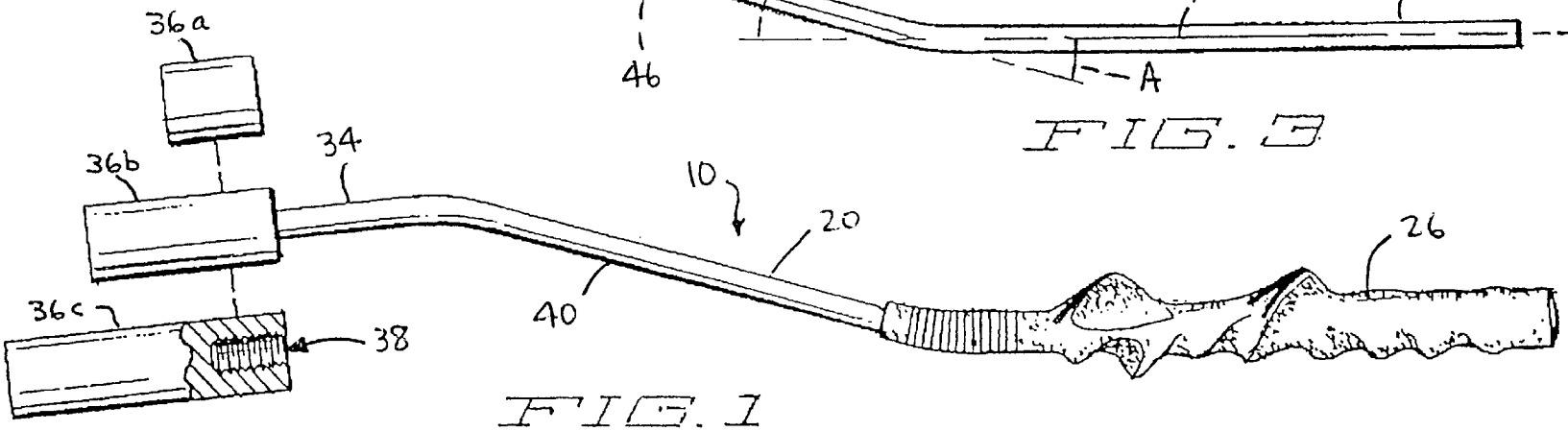
FIG. 1 is a plan view of the preferred embodiment of the swing training device, club or "swing trainer" 10 of the present invention when lying on a horizontal surface (not shown), and showing a preferred training grip 26 on the upper or proximate end 24 of the shaft 20 and a plurality of detachable weighted heads 36*a*, 36*b*, 36*c*, one of which 36*b* is attached to the lower or distal end 34 of the shaft 20, and two others 36*a*, 36*c* which are detached; and one of which 36*c* shown in partial cross section to show a thread shaft engagement opening 38.

As illustrated in FIGS. 1–3, the present invention provides a golf swing training and muscle exercising device 10 or "swing trainer" preferably having a solid shaft that is bent within a single plane at least about 12 degrees in a first direction and then bent back at least about 12 degrees in second direction. In one preferred embodiment both of these angles are at least about 15 degrees or greater. This allows for a shorter swing trainer or club 10. It is believed that the shorter length club is easier to keep in balance which makes it easier to use than a longer club of this kind.

The preferred swing trainer includes a double bent shaft 20 having a proximate end or upper portion 24 a distal end or lower portion 34 and a center portion 40. The proximate end 24 is preferably equipped with a handgrip 26 and a weighted head 36 is preferably engaged with a threaded end portion 37 of distal end 34. The weighted head 36 may be anyone of a number of weighted heads 36*a*, 36*b*, 36*c* which can be detachably engaged with the threaded end portion 37 of the distal end 34. Each of the weighted heads preferably have a threaded shaft engagement open 38 similar to that shown in the partially broken away section of on e of the weighted heads 36*c* shown in FIG. 1.

The double bent shaft 20 is bent in a way to maximize the effectiveness of the swing trainer 10. Each of the upper end, lower end and center portions 24, 34, 40, respectively, have center lines 42, 44, 46, respectively, shown as broken lines in FIG. 3. Each center line is substantially straight. The center line 42 for the center portion 24 is the first center line 42, the center line 46 for the center portion 40 is the second center line 46 and the center line 44 for the lower end portion 34 is the third center line; the first center line 42 lying at and angle A to the second center line 49 and the second center line 46 lying at an angle B to the third center line, wherein angle B is preferably greater than angle A.

In preferred embodiments, angle A will be less than angle B and will be about 12 to about 23 degrees, preferably about 15 degrees; and angle B will be about 18 to about 25 degrees, preferably about 19 to about 24 degrees, more preferably about 20 to about 23 degrees, most preferably about 21.5 degrees.

Detachable weighted heads 36 of various weight sizes are engaged with the lower end 34 and a training grip 26 is installed on the proximate end 24. The two bends simulate the movements of a proper golf swing and also exercises the proper muscles of the golfer making such a swing, while the training grip 26 places the club 10 in the proper position for easy learning. The weighted ends 36 are designed in various sizes to accommodate the different needs of different sized golfers, and are easy to install and remove. The short length of the swing trainer 10 or "club" makes it usable indoors as well as outdoors, and it is designed to develop tempo and timing in the golf swing, along with several other swing features.

The present swing trainer 10 is designed to be relatively short in length so that it can be carried in most suitcases and even some briefcases is disassembled, as used both indoor or outdoors. The short length of the preferred swing trainer 10 allows golfers to exercise the proper muscles and swing when indoors during the off season, or periods of particularly inclement weather which prevents one from being outside. The club 10 is designed short in length so it can be stored easily inside a golfer's bag. The club shaft 20 itself weighs approximately 1½ lbs and lit is made of durable steel, preferably metal bar stock. The shaft 20 is double bent to create the proper placement during the swing. At the proximate end 24 of the shaft 20 is a training grip 26 (commonly purchased from retailers) that teaches the proper placement of the hands on the grip 26. At the distal end 34 of the shaft 20 is a changeable weighted head 36 preferably made of steel or any other suitable material. The weighted heads 36 are easily changed to add preferably from about ½ to about 1½ lbs more weight to the shaft at the distal end 34, depending on what the golfer feels comfortable swinging. During the backswing, the weights promote a slow take away, and start to develop the proper inside to outside swing path. By adding the proper weight, makes the invention versatile as a teaching aid or as a warm-up club. For smaller children, no weights need to be added to the shaft 20; the shaft 20 still functions without the weights, because of the double bent shaft 20, although added weight will enhance the function.

The shaft 20 has two bends that are designed to: (1) rotate the forearms during the backswing and downswing causing the hands to automatically release, thus returning the club to the most desirable impact position; (2) Place the club 10 in the proper position at the top of the backswing, so that the arms are in position to drop back down into the proper "inside-outside" swing; (3) Help the transferring of weight to the back foot during the backswing and to the front foot during the downswing (4) Helps to cure the slice by preventing the golfer from improper weight transfer and downswing; (5) Helps the golfer automatically cock and uncock the wrists at the proper positions thereby generating more club head speed; and (6) Teaches the golfer the feel of a full release and how a completed proper high finish of the swing feels, especially at the end of the swing.

Figure 4:
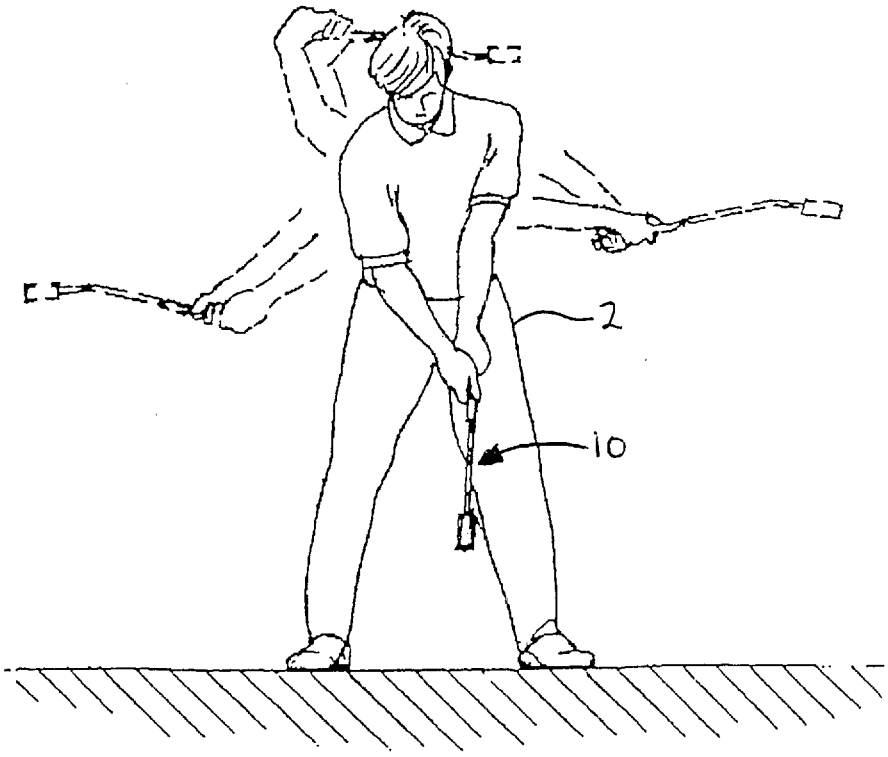
Figure 5:
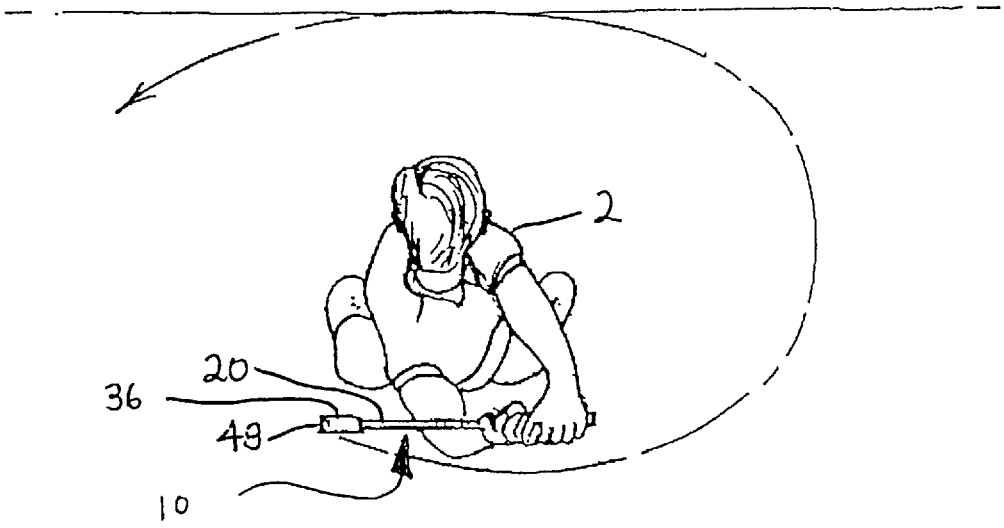
FIG. 5 is a schematic top view of a person 2 grasping the swing training device or "swing trainer" 10 of the present invention at the top of the backswing, similar to that shown in broken line in FIG. 4, when one would hope the swing trainer was held in such a position that the center lines (not shown) of the respective linear portions of the shaft 20 are all in a vertical plane consistent with the vector of the pull of gravity; and also showing in broken line a desired line for the path of an end 48 of the weighted head 36 on the lower end 34 of the swing trainer 10 as the swing is properly completed.

Referring now also to FIGS. 4 and 5, one advantage of this invention is it's ability to position the hands in the proper position at the top. This is a key of the two bends in the shaft 20. If the golfer does not get their arms and hands cocked and placed in the proper position, the entire swing is generally flawed. If the golfer places his or her hands at the top of the swing too low or flat, the club 10 will feel heavy. If the hands are too high at the top of the swing, again the club 10 will feel heavy. Because of the design uniqueness of the bends, it is believed to be almost "automatic" that the hands will be in the proper position. From this proper position, a golfer is now ready to start the down swing and has a great chance of dropping the club 10 into the proper "inside to outside" path necessary to hit straight shots with power, thus creating more length or distance in the shots.

To properly swing use the preferred swing trainer 10, a golfer has to clear their hips on the downswing, if they don't they will virtually not be able to make the swing. It is important to have the hips clearing the pathway, so that the arms can drop inside for a powerful hit. The present invention can be used advantageously to teach this.

To use the preferred invention, apply and maintain a proper grip (this is easy because of the use of the special training grip mention above), stance and setup. Referring now particularly to FIG. 4, begin a slow sweeping take away, letting the swing trainer's design rotate the forearms and the natural cocking of the wrists, at the top of the swing, shown also in FIG. 5, the club 10 will be in perfect position (weight transfers to the back foot) to start the downswing. You will feel your legs, shoulders, hips, arms, wrists and hand muscles, participating in the movements. The hips will clear leading to a high finish of the perfect golf swing. Fast and hard swinging is not necessary and in fact is not recommended during practice or during an actual round of golf. The invention will create a perfect swing on it's own.

Golfers who practices regularly at home, in the office, or any other convenient place with this invention, will become a more consistent and confident golfer. Muscle memory of a fall and easy wing will be developed; this muscle memory is easily transferred to the golf course, leading to more consistent shots, and better scores.

Practice with the trainer 10 of the present invention accentuates what a golfer "feels" his or her muscles to be experiencing during the swing, making him or her more aware of each swing element as it is completed. Also, the trainer head weight 36 and its distribution provides a moment arm effect during that practice that encourages a smooth transition between each element or action of the swing. Additionally, the weighted club head arrangement, relative to a golf club effective center line, encourages a golfer to transfer his weight in exaggerated fashion, which weight transfer assists the golfer in maintaining his balance throughout the swing. The weighted head arrangement encourages the proper castering effect during the release portion of a golf swing and, in fact, the harder the club is swing the more this tendency of the hands to rotate with respect to one another to create this second lever rotating action is accentuated. It is this accentuated second lever rotation that tends to generate better directional control and a greater distance of ball travel when applied to swinging a conventional club. All in all, practice of a golf swing with the trainer 10 enables the golfer to recognize or "feel" the proper sequence of actions that make up a desirable golf swing.

The trainer 10 of the present invention can be used by a golfer picking it up and swinging it any time he has a few spare moments. Through such repeated and redundant swinging a muscle conditioning and mental imprinting of the elements or aspects of the desired golf swing takes place, which will carry over to swinging a conventional golf club. Swinging the trainer provides a dynamic interaction between the components or aspects of the swing, that with practice, will smooth together. The irregularities and jerkiness that are traits of the average golf swing, will thereby be eliminated, and a blending of motion into a well-timed and flowing golf swing will be provided. In practice, it has been found that exercise with the trainer as at a ¾ metronome pace will produce a very relaxed swing.

With redundant swinging of the trainer in a range of approximately 30 to 40 repetitions per minute, a novice golfer's speed of swing has been refined from 12 percent to 7 percent variation; an intermediate golfer's swing has been refined between 10 percent to 5 percent variation; and a low handicapper's swing has been refined from approximately 7 percent to 3 percent in club head speed consistency. Additionally, in all cases, the timing and the release action of each golfer's swing has improved as has the swing smoothness or tempo, and each golfer tested was observed to experience some relative improvement in squaring the club head relative to the target line.

The preferred golf swing trainers will also be about 32 inches or less in length, preferably 26 inches or less, for easy use inside or out. The shaft of the swing trainer is bent oppositely at spaced apart points along the shaft to off-set the lower end portion of the shaft outwardly from an upper end portion of the shaft. The weighted head is secured on the lower end portion of the shaft and a hand grip is telescoped over the upper end portion of the shaft. The preferred hand grip is a training grip which includes contoured depressions to accommodate a golfer's fingers when properly griping the shaft. The training grip has elevated portions around or to the sides of which the "V area" between the thumb and forefinger of a golfer's hands, so as to position the golfer's hands appropriately relative to the shaft of the swing trainer. The weighted head is removable and replaceable with weighted heads of any number of practical weights. The shaft is double bent, such that the weight provided by the head will be generally centered outwardly and above the center line of the upper end portion of the shaft.

The double bending of the shaft 20 of the present swing trainer 10 is essential to the present invention. It functions to promote a proper position at the top of the swing, promote a proper swing path and allow the wrists and hands to release, which is necessary to prevent hooking and/or slicing.

The grip 26, covers the top part of the shaft and is positioned to align the indicia with the top angle of the shaft and weight. The swing weights 36*a*, 36*b*, 36*c* function to promote added muscle development and allow the flexibility to meet the needs of all sizes, abilities, and athletic needs of individual golfers. The shaft itself will work without the weights, as may be the case with a small child. The preferred swing weights 36*a*, 36*b*, 36*c* are round and are made of steel they are drilled and tapped with threads so they will merely turn on and off the steel shaft 10. However, other formable shapes may be employed and other materials could be employed, e.g., plastics, metals other than steel such as lead, brass or the like, cement, natural materials such as wood, rock or the like, and other suitable materials.

The swing weights are mounted to the swing shaft 20 by turning it on like you would a nut on to a bolt. The steel shaft 10 is threaded and the weights are drilled and tapped with the proper threads to turn on the shaft. Advantageously, the weights are balance to promote a smooth rotation of the invention, no matter which size weight is used.

EXAMPLE I

The present invention will be further illustrated with reference to the following steps which will aid in the understanding of the present invention, but which are not to be construed as limitations thereof, but only descriptive of the preferred embodiment.

Step One:

The basic component of the shaft 10, for the invention is preferably made of metal (e.g., steel, brass, lead, cooper, etc.) rod, shaft, or pipe preferably having an outer diameter (OD) of about 9/16". Usually this material is available in 10 or 20 foot lengths, which for this embodiment is then cut to lengths of about 22 inches. Commercial sources of suitable material may be found nationwide.

Step Two:

The steel shaft 20 is threaded (9/16") at one end where the weights 36 will be attached. The shaft is bent approximately 21.5 degrees up 3½ inches from the end of the distal treaded end 34. Approximately 8 inches further up the shaft 20 12 degree bend is made.

Step Three:

The different weighted head sizes are made, with the smaller weight 36*a* being approximately 1½ inches in length and weights about 0.5 pounds. The cylinder of each of the weights is made of steel and is approximately 1¼ inches in diameter. The middle sized weight 36*b* is approximately 2¾ inches long and weights about 1.0 pounds, and the large weight is approximately 4 inches long and weighs about 1.5 pounds. Any of the shapes or lengths of the weighted heads can be varied to make other desired weight selections.

Step Four:

The weights are dimpled in the center with a punch and hammer, on one end. A ½" inch hole is drilled in the center of the end of each of the weights, the holes are approximately ⅞" deep. The holes are then tapped out to 9/16" in order to provide mating 9/16" threads so that they will turn on to the threaded end 34 of the shaft 20.

Step Five:

The steel shaft and weights are then cleaned, primed and coated with a suitable finish or covering preferably a paint or rubber coating).

Step Six:

Next the training grip 26, is placed on the untreaded end of the steel shaft 20. A piece of two faced tape approximately 10 inches long is put on the steel shaft 10, a special solvent that is used to put on grips is poured in to the grip and on the tape so that the training grip 12 will slide on the steel shaft 10 with ease. The indicia that indicate where the thumbs and fingers of a player are to located are placed on the top side of the steel shaft 20 in alignment with the two bends in the shaft.

Step Seven:

To assemble the desired weight on the shaft is merely the turning the tapped weight end onto the treaded end of the shaft. Hand tightening is sufficient, with no tools necessary.

Preferred Embodiment—Operation

The steel shaft 20 is double bent to create the position of the club 10 in the proper place during the backswing, at the top of the back swing, during the downswimg and on through to the high finish that golf experts like to see in their students. The threaded end 34 of the steel shaft 20 is designed so that it is easy to put on the suitable weight for the individual user of the invention. The double bend of the steel shaft 20, is designed to roll the forearms over at the proper time in both the backswing and the downswing, thus squaring the club head at impact to a strong hitting position and correct flight of the golf ball.

The small weight 36*a* is drilled and threads are tapped in it so that it will easily turn on the threaded end of the steel shaft 20. The same is true for the medium weight 36*b* and the large weight 36*c*. The proper sized weight will develop a stronger golfer by utilizing and strengthening the proper muscles required in a perfect swing.

The training grip 26, is installed so that the golfer learns to place their hands on the grip properly, these are bought from various vendors and are nothing new to the golf industry. These grips are utilized to make sure that the club is held at the proper angles in conjunction with the steel shaft 20, so the club 10 will function properly throughout the swing. This proper swing will build proper muscles required in a perfect inside-out swing. The materials used are common and therefore keeps the price of the invention down so that ordinary golfers can afford to purchase one.

Accordingly, it can be seen that the present invention is practical, suited for all ages, genders, and both right handed and left handed golfers. The invention develops the perfect swing and builds the proper muscles that are required. The invention does the following, 1) teaches where to properly place the hands on a club, 2) places the club in the proper position at the top of the backswing, so that the arms and body are in position to promote the correct downswing, 3) teaches the proper cocking and uncocking of the wrists, 4) rotates the forearms both during the backswing and the downswing, 5) promotes a full release on the downswing, 6) forces the right transferring of weight to the back foot during the backswing and to the front foot during the downswing, 7) cures the slice by preventing the golfer from "reverse C" during downswing, 8) develops the proper swing muscles, 9) the invention can be used as a warm up at the golf course, 10) be used indoors due to it's size, 11) develop proper swing speed and tempo, and 12) comes with different size weights for individual preferences.

Although the description above contains many specificities, these should not be construed as limiting the scope of the invention but as merely providing illustrations of some of the presently preferred embodiments of this invention. Various other embodiments and ramifications are possible within it's scope. For example, different colors may be used, different size weights may be used, different materials for metals might be used, and different finishing materials may be used.

It is to be understood, therefore, that even though numerous characteristics and advantages of the present invention have been set forth in the foregoing description, together with details of the structure and function of present invention, the sequence or order of the specific steps, or the actual compositions or materials used may vary somewhat. Further more, it will be appreciated that this disclosure is illustrative only and that changes may be made in detail, especially in matters of shape, size, arrangement of parts or sequence or elements of aspects of the invention within the principles of the invention to the full extent indicated by the broad general meaning of the terms in which the appended claims are expressed. While a preferred embodiment of the present invention in a golf swing trainer has been shown and described herein, it should be understood that the described embodiment is presently contemplated to be a best or preferred mode for carrying out the invention only and in actual practice can be varied and changes made thereto, without departing from the subject matter coming within the scope of the following claims, which claims I regard as my invention.

What is claimed is:

1. A golf swing trainer having a first end and a second end, the first end being an end that is gripped by a user and the second end being an end, distal to the first end, that is swung by the user when gripping the first end, the swing trainer comprising: a shaft having upper and lower end portions separated by a center portion, the center portion being interconnected, at opposite ends thereof, with each of the upper and lower end portions by first and second joining portions, the upper end portion being located at the first end, wherein the swing trainer has a length which is the distance between an upper end of the first end and a lower end of the second end, and the length is about 32 inches or less, each of the center portion and the upper and lower end portions being substantially straight and having respective center lines, wherein the center line for the upper end portion is the first center line, the center line for the center portion is the second center line and the center line for the lower end portion is the third center line, wherein the first center line, second center line and third center line all lie in the same plane, the first center line standing at an angle A to the second center line and the second center line standing at an angle B to the third center line, wherein angle A is from about 12 degrees to about 23 degrees and angle B is from about 18 degrees to about 25 degrees, so long as angle B remains greater than angle A.

2. The golf swing trainer of claim 1 further comprising a grip engaged with the first end.

3. The golf swing trainer of claim 2 wherein the grip is a training grip.

4. The golf swing trainer of claim 1 further comprising a weighted head engaged with the second end.

5. The golf swing trainer of claim 4 wherein the weighted head is detachably engaged with the second end of the swing trainer and weighs from about 0.5 to about 3.0 pounds.

* * * * *